US008776448B2

(12) United States Patent
Bradly et al.

(10) Patent No.: US 8,776,448 B2
(45) Date of Patent: Jul. 15, 2014

(54) COMPOSITE CANTILEVERED BALCONY

(71) Applicant: CCI Balconies Inc., Ottawa (CA)

(72) Inventors: David Bradly, Nepean (CA); Philip Locker, Kanata (CA)

(73) Assignee: CCI Balconies Inc., Ottawa (CA)

( * ) Notice: Subject to any disclaimer, the term of this patent is extended or adjusted under 35 U.S.C. 154(b) by 0 days.

(21) Appl. No.: 13/973,331

(22) Filed: Aug. 22, 2013

(65) Prior Publication Data

US 2014/0053473 A1 Feb. 27, 2014

Related U.S. Application Data

(60) Provisional application No. 61/691,828, filed on Aug. 22, 2012.

(51) Int. Cl.
*E04B 1/34* (2006.01)

(52) U.S. Cl.
USPC ..... 52/73

(58) Field of Classification Search
CPC ..... E04B 1/003; E04B 1/0038
USPC ..... 52/73, 75, 76, 78, 250, 251
See application file for complete search history.

(56) References Cited

U.S. PATENT DOCUMENTS

| | | | | |
|---|---|---|---|---|
| 4,548,003 | A * | 10/1985 | Johansson et al. | 52/73 |
| 5,483,773 | A * | 1/1996 | Parisien | 52/73 |
| 8,096,084 | B2 * | 1/2012 | Studebaker et al. | 52/73 |
| 8,201,363 | B2 * | 6/2012 | Studebaker et al. | 52/73 |
| 2006/0090416 | A1 | 5/2006 | Braasch et al. | |
| 2008/0127600 | A1 * | 6/2008 | Schiffmann et al. | 52/741.1 |

FOREIGN PATENT DOCUMENTS

WO WO 2011/00596 A1 1/2011

OTHER PUBLICATIONS

Office Action from corresponding Canadian application Serial. No. 2824532, issued Nov. 15, 2013.

* cited by examiner

*Primary Examiner* — Mark Wendell

(57) ABSTRACT

A balcony assembly for attachment to a load-bearing structure of a building is provided. The assembly has a plate of low thermal mass composite material such as fiberglass. A supporting structure attached to the plate provides rigidity. An anchor is configured to attach one side of the balcony assembly to a floor of the building in a cantilevered arrangement. The balcony assembly is useful in minimizing heat transfer through concrete floor slabs, and has the added benefit of reducing the overall weight of the balcony, which in turn allows lighter construction of the building.

20 Claims, 2 Drawing Sheets

COMPOSITE CANTILEVERED BALCONY

CROSS-REFERENCE TO RELATED APPLICATION

The present patent application claims the benefit of U.S. Provisional Patent Application Ser. No. 61/691,828, entitled "Composite Cantilevered Balcony", and filed on Aug. 22, 2012, the entire contents of which are incorporated herein by reference.

FIELD OF THE INVENTION

The present invention relates to the field of structural engineering. In particular, the invention relates to the construction of balconies for buildings.

BACKGROUND

A problem with the construction of buildings, such as apartments or condominium towers, involves thermal efficiency. While government regulation and public momentum demand that such buildings be energy efficient, typically heat transfers through balconies are inadequately addressed.

For example, conventional balconies are cast in concrete. To dissipate heat, thermal breaks or isolation brackets consisting of insulated steel structural members can be installed between the balconies and floor slabs of the buildings. However, such isolation brackets substantially increase the cost and complexity of the balconies.

SUMMARY OF THE INVENTION

Embodiments of the invention solve the problem of heat transfer through balconies by using composite materials.

Composite materials provide a layer of insulation in construction. Various approaches to applying composite materials were considered. One approach involves composite isolation brackets that are similar to steel isolation brackets. However, this approach was disregarded due to cost of manufacture and lack of acceptance in the construction industry.

Another approach involves sheathing existing or new concrete balconies in composite layers to insulate them from temperature changes, so as to reduce energy loss to the environment. This approach was investigated extensively for insulation (R-value) and cosmetic improvement to existing buildings. However, this approach was disregarded due cost of manufacture, lack of a standard-sized balcony in the construction industry, and issues with rail mounting and drainage.

Another approach involves fully composite balconies. Use of composite materials of low thermal mass reduces thermal transfer to buildings. Their low weight has the added benefit of reducing the overall weight of balconies. Such use also facilitates the installation of balconies onto buildings.

While fiberglass balconies having front supporting posts could be used in theory, they are suited for buildings of only two or three stories tall. Instead, composite balconies are cantilever-mounted, and anchored to floor slabs of buildings with reinforcement bars known as rebar for example. Cantilevered composite balconies are difficult to design and manufacture, and must be installed when buildings are constructed. Composite balconies of the kind described herein have not been considered before due in part to the construction industry's familiarity with the materials, manufacture, and design of conventional balconies. Constructing cantilevered composite balconies requires knowledge of the field of composite materials, consistent and cost effective production methods, ease of anchoring to existing structures, and compatibility with typical methods of construction.

According to an aspect of the invention, there is provided a balcony assembly for attachment to a load-bearing structure of a building, the balcony assembly comprising: at least one plate of composite material having low thermal mass; a supporting structure attached to the at least one plate and providing rigidity to the balcony assembly; and an anchor protruding from one side of the balcony assembly and configured to attach the one side of the balcony assembly to the load-bearing structure of the building in a cantilevered arrangement.

In some embodiments, the supporting structure is made of composite material having low thermal mass.

In some embodiments, the supporting structure is made entirely of the composite material.

In some embodiments, the supporting structure is made of pultruded fiberglass.

In some embodiments, the supporting structure comprises a plurality of ribs distributed across the at least one plate.

In some embodiments, the plurality of ribs comprises plates of fiberglass.

In some embodiments, a rib of the plurality of ribs is tabbed to the at least one plate with fiberglass.

In some embodiments, a rib of the plurality of ribs is bonded to the at least one plate by adhesive.

In some embodiments, the composite material is made of fiberglass, fiber-reinforced plastic, or foam core, or any combination thereof.

In some embodiments, the composite material has a low thermal mass of at least less than 0.10 W per mK.

In some embodiments, the at least one plate comprises a pair of plates that enclose the supporting structure in a parallel arrangement.

In some embodiments, the at least one plate is a cored composite plate.

In some embodiments, the at least one plate is made of a core material nested in unidirectional fiberglass and further nested in biaxial fiberglass 0/90 plus chopped strand mat.

In some embodiments, the at least one plate is made of unidirectional fiberglass oriented parallel to the plurality of ribs.

In some embodiments, the anchor protruding from the one side of the balcony assembly protrudes from one side of the supporting structure.

In some embodiments, the anchor is integral with the supporting structure.

In some embodiments, the anchor comprises a portion of the plurality of ribs that extends beyond the one side of the supporting structure.

In some embodiments, the plurality of ribs is adapted to mesh with a reinforcement bar.

In some embodiments, the one side of the balcony assembly forms a notch configured to distribute weight bearing of the balcony assembly over the notch, when the balcony assembly is attached to the load-bearing structure of the building.

According to another aspect of the invention, there is provided a balcony attached to a load-bearing structure of a building, the balcony comprising: at least one plate of composite material having low thermal mass; and a supporting structure attached to the at least one plate and providing rigidity to the balcony; wherein one side of the balcony is attached to the load-bearing structure of the building in a cantilevered arrangement.

Other aspects and features of the invention will become apparent to those ordinarily skilled in the art upon review of the following description of specific embodiments of the invention.

BRIEF DESCRIPTION OF THE DRAWINGS

The invention will now be described in greater detail with reference to the accompanying drawings, in which.

DETAILED DESCRIPTION OF EMBODIMENTS

Figure 1:
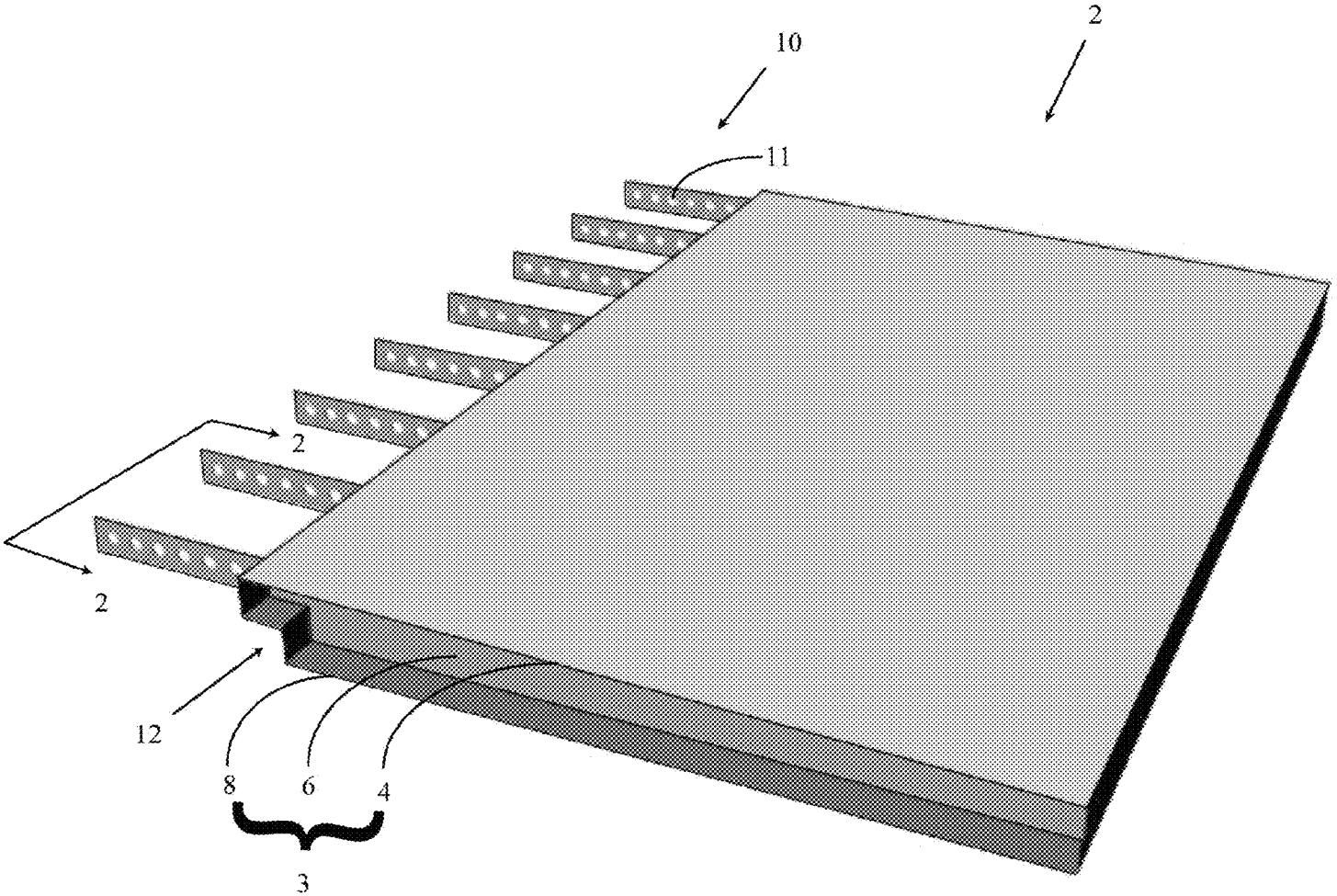
FIG. 1 is a perspective view of a balcony assembly according to an embodiment of the invention.

FIG. 1 is a perspective view of a balcony assembly 2 according to an embodiment of the invention. The balcony assembly 2 is configured for attachment to a load-bearing structure of a building (not shown), such as a floor structure, wall, or other part of a building.

The balcony assembly 2 has a platform 3 that includes at least one plate such as a pair of plates 4, 8, and a supporting structure such as ribs 6 distributed across the pair of plates 4, 8. It will be understood that plate in this context means a generally plate-like structure, and does not imply that the plate is flat. The balcony assembly 2 also has an anchor such as anchoring system 10.

Referring to the pair of plates 4, 8, the plates enclose the ribs 6. The pair of plates 4, 8 are placed parallel to each other. It will be understood that parallel in this context means that the plates lie generally side-by-side. Strict parallelism in a mathematical sense is not required. While FIG. 1 shows the balcony assembly 2 using the pair of plates 4, 8, more than two plates can be used instead. Alternatively, only one plate can be used, with the plate placed underneath or above the ribs 6.

The pair of plates 4, 8 are constructed from composite material having low thermal mass. Examples of suitable composite materials having low thermal mass include fiberglass, fiber-reinforced plastic (FRP), and foam core. In contrast to concrete which has a thermal transfer coefficient of 1.0-1.8 W/mK, foam core has a thermal transfer coefficient of 0.045 W per mK, which is 40 times better than concrete; and a plate of fiberglass has a thermal transfer coefficient of 0.04 W/mK, which 45 times better than concrete. Generally, composite materials having a low thermal mass will have a low thermal transfer coefficient, for example at least less than 0.10 W per mK. Such composite materials typically have low overall mass relative to concrete. Flex, strain, and ultimate strength were considered in determining these materials. In this example, the pair of plates 4, 8, are cored composite plates.

Referring to the ribs 6, the ribs are attached to the pair of plates 4, 8 and provide rigidity to the balcony assembly 2. The ribs 6 separate the pair of plates 4, 8. In this example, the ribs 6 are constructed from fiberglass such as solid pultruded fiberglass, fiberglass plates, or the like, and vertically oriented.

The ribs 6 in the balcony assembly 2 are designed to allow custom layup at the critical pivot point from a concrete step to the balcony. In particular, the highest loads occur at the point where the balcony assembly 2 transitions from composite sandwich construction in the pair of plates 4, 8 to the ribs 6 anchoring into a concrete slab in a wall of the building. A notch 12 integrated into the rear of platform 3 serves as a concrete former.

Referring to the anchoring system 10, the system attaches the rear of the balcony assembly 2 to the load-bearing structure of the building in a cantilevered arrangement. The anchoring system 10 is constructed to hold the balcony assembly 2 to the building, as discussed in more detail below. In this example, the anchoring system 10 consists of the portion of the ribs 6 that extend beyond the rear of the balcony assembly 2, where they define pre-drilled holes 11 that are sized to receive rebar transversally.

In use, the balcony assembly 2 is constructed to be placed into position prior to an adjacent floor slab being poured in concrete, of the pour-in-place type, for example. The notch 12 forms the concrete step at the edge of the slab of concrete, to increase the bearing surface of the ribs 6. The notch 12 is placed on the concrete step, to support the rear of the platform 3 on the slab of concrete. The ribs 6 extending beyond the rear of the balcony 2 enter the slab of concrete in the floor of the building, and mesh with rebar to prevent pull-out. The ribs 6 anchor into the slab of concrete, and receive rebar through the holes 11. The ribs 6, rebar, and concrete secure the balcony assembly 2 to the floor.

The balcony assembly 2 is dimensioned according to conventional dimensions, for example 10 feet wide by 6 feet deep, tapering in thickness from 8 inches at the building to 6 inches at an outside edge. Calculations are performed to ensure the balcony assembly 2 meets building code load requirements. Composite materials having low thermal transfer can be engineered to meet the loading requirements specified by building codes.

Figure 2:
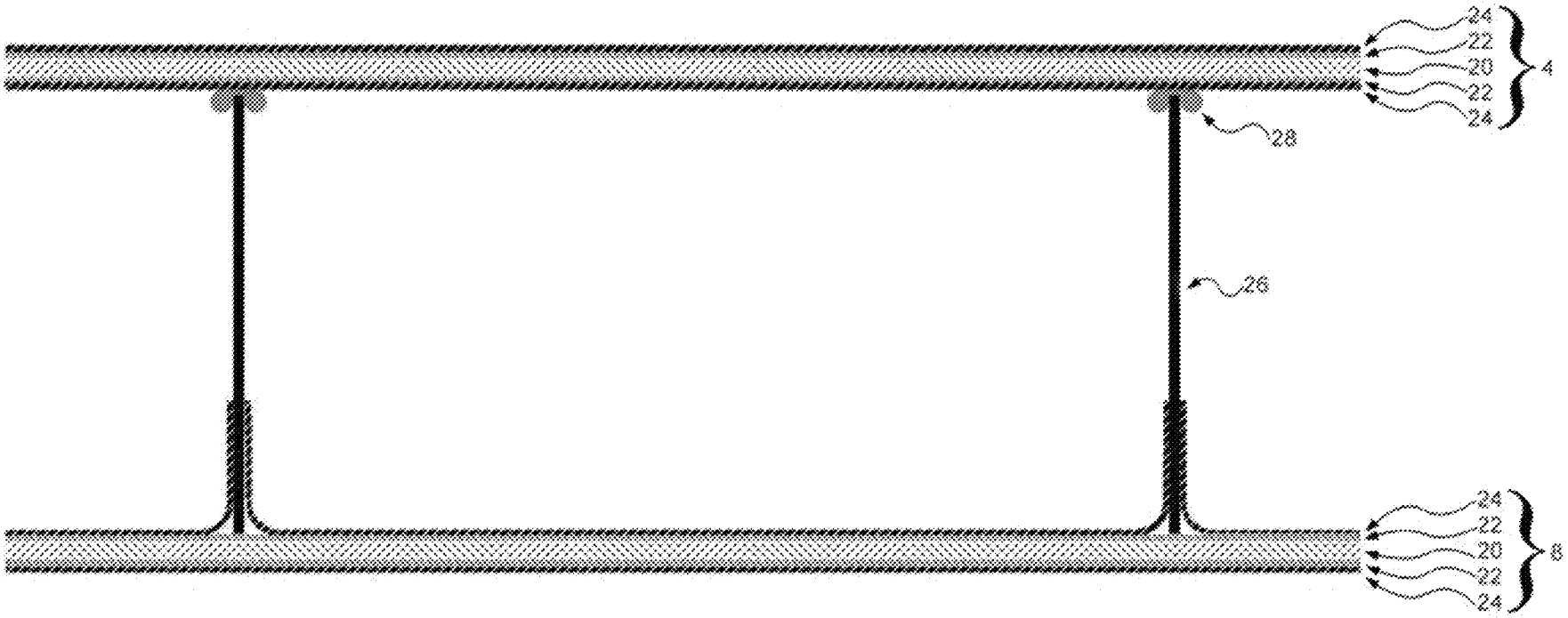
FIG. 2 is a cross-sectional view along line 2-2 of FIG. 1.

FIG. 2 is a cross-sectional view taken along line 2-2 of FIG. 1. In this example, the pair of plates 4, 8 are made of cored composite plates consisting of unidirectional fiberglass 22 and biaxial fiberglass 0/90 plus chopped strand mat 24 on either side of a core material 20. The ribs 6 are made of a fiberglass plate 26, which has a thickness that is tailored. In this example, the ribs 6 are tabbed to plate 8 with fiberglass cloth when the plate is laminated, but could be alternately bonded with adhesive in a secondary operation. Plate 4 is laminated separately, and then bonded to the ribs 6 in a secondary step by adhesive 28, such as Plexus™ or the like. The unidirectional fiberglass 22 is oriented parallel to the ribs 6 to decrease deflection.

Other designs are possible. Materials are subject to variation on application. Throughout the process, safety, cost effectiveness, low thermal mass, and low actual mass are considered. Balconies must meet various requirements, which are typically based on average and point loading, wind loading and fire safety. This makes constructing a balcony complex. Deflection under load must be controlled to acceptable levels. Recognized safety factors in the construction industry are usually around 1.75 minimum, such as 2. Composite manufacturing can decrease cost through prefabrication, without compromising safety, functionality or form.

Suitable flooring or other material can be applied to a plate. For example, a finishing layer may be applied to provide the floor, or the floor may be provided by the plate itself.

The balcony can be used in multi-story buildings, such as in high-rise residential buildings, for example.

In addition to reducing heat transfer, the composite material has low overall weight. The balcony assembly facilitates installation. As the balcony assembly is cantilever-mounted, it is accepted as an alternative product to conventional concrete balconies. The balcony assembly is prefabricated from composite materials such as fiberglass and delivered to a job site ready-to-install, in contrast to conventional balconies which are poured-in-place from concrete. The balcony assembly is much lighter in weight than concrete balconies, allowing associated structural members of the building to be reduced accordingly. The balcony assembly reduces heat transfer by using composite materials, which have low thermal transfer compared to concrete. It is anchored to the building slab by the supporting structure and transverse rebar which hold the balcony in place once the floor slab of the building is poured. The balcony assembly provides a cost effective alternative to thermal breaks.

What has been described is merely illustrative of the application of the principles of the invention. Other arrangements and methods can be implemented by those skilled in the art without departing from the scope of the invention.

The invention claimed is:

1. A balcony assembly for attachment to a load-bearing structure of a building, the balcony assembly comprising:

at least one plate of composite material having low thermal mass;

a supporting structure attached to the at least one plate and providing rigidity to the balcony assembly, the supporting structure being formed of ribs integral with the at least one plate; and an anchor protruding from one side of the balcony assembly and configured to attach the one side of the balcony assembly to the load-bearing structure of the building in a cantilevered arrangement;

wherein the at least one plate, and the supporting structure, are made of fiber reinforced plastic.

2. The balcony assembly of claim 1, wherein the supporting structure is made of composite material having low thermal mass.

3. The balcony assembly of claim 2, wherein the supporting structure is made entirely of the composite material.

4. The balcony assembly of claim 2, wherein the supporting structure comprises a plurality of ribs distributed across the at least one plate.

5. The balcony assembly of claim 4, wherein the plurality of ribs comprises plates of fiberglass.

6. The balcony assembly of claim 4, wherein a rib of the plurality of ribs is tabbed to the at least one plate with fiberglass.

7. The balcony assembly of claim 4, wherein a rib of the plurality of ribs is bonded to the at least one plate by adhesive.

8. The balcony assembly of claim 4, wherein the at least one plate is made of unidirectional fiberglass oriented parallel to the plurality of ribs.

9. The balcony assembly of claim 4, wherein the anchor comprises a portion of the plurality of ribs that extends beyond the one side of the supporting structure.

10. The balcony assembly of claim 4, wherein the plurality of ribs is adapted to mesh with a reinforcement bar.

11. The balcony assembly of claim 1, wherein the supporting structure is made of pultruded fiberglass.

12. The balcony assembly of claim 1, wherein the composite material is made of fiberglass, fiber-reinforced plastic, or foam core, or any combination thereof.

13. The balcony assembly of claim 1, wherein the composite material has a low thermal mass of at least less than 0.10 W per mK.

14. The balcony assembly of claim 1, wherein the at least one plate comprises a pair of plates that enclose the supporting structure in a parallel arrangement.

15. The balcony assembly of claim 1, wherein the at least one plate is a cored composite plate.

16. The balcony assembly of claim 15, wherein the at least one plate is made of a core material nested in unidirectional fiberglass and further nested in biaxial fiberglass 0/90 plus chopped strand mat.

17. The balcony assembly of claim 1, wherein the anchor protruding from the one side of the balcony assembly protrudes from one side of the supporting structure.

18. The balcony assembly of claim 17, wherein the anchor and the supporting structure are of unitary construction.

19. The balcony assembly of claim 1, wherein the one side of the balcony assembly forms a notch configured to distribute weight bearing of the balcony assembly over the notch, when the balcony assembly is attached to the load-bearing structure of the building.

20. A balcony attached to a load-bearing structure of a building, the balcony comprising:

at least one plate of composite material having low thermal mass; and a supporting structure attached to the at least one plate and providing rigidity to the balcony, the supporting structure being formed of ribs integral with at least one said plate;

wherein one side of the balcony is attached to the load-bearing structure of the building in a cantilevered arrangement;

wherein the at least one plate, and the supporting structure, are made of fiber reinforced plastic.

* * * * *